US005989068A

United States Patent [19]

Shu

[11] Patent Number: 5,989,068

[45] Date of Patent: Nov. 23, 1999

[54] DECORATIVE LIGHT BULB HOLDER STRUCTURE

[76] Inventor: Kuo-Fen Shu, No. 10, Lane 198, Chung Chang Road, Hsinchu, Taiwan

[21] Appl. No.: 09/114,479

[22] Filed: Jul. 13, 1998

[51] Int. Cl.[6] ..... H01R 19/00

[52] U.S. Cl. ..... 439/619

[58] Field of Search ..... 439/619, 611–618, 439/699.2, 356

[56] References Cited

U.S. PATENT DOCUMENTS 5,791,940 8/1998 Chen et al. ..... 439/619

5,810,621 9/1998 Tsai ..... 439/619

5,879,195 3/1999 Cheng ..... 439/619

*Primary Examiner*—Lincoln Donovan

*Assistant Examiner*—Eugene G. Byrd

*Attorney, Agent, or Firm*—Rosenberg, Klein & Lee

[57] ABSTRACT

An improved decorative light bulb holder structure comprises a light bulb holder, a socket shell, and a light bulb, and can provide convenience in assemblage and wire routing. The light bulb holder has a specially designed connection column at one end that, in conjunction with two electrical wires, can be closely embraced by the socket shell to reach a sealing effect and to prevent the penetration of moisture.

3 Claims, 5 Drawing Sheets

DECORATIVE LIGHT BULB HOLDER STRUCTURE

BACKGROUND OF THE INVENTION

In a prior art structure, a miniature light bulb is mounted on a holder and then they together with two electrical wires are housed in a socket shell. FIG. 1 shows a conventional light bulb holder structure that includes a holder (1) and a light bulb (2). The holder (1) is equipped on one end with a connection column (11). The connection column (11) has semi-circular grooves (12) on two sides and communicates with the main body of the holder (1) by means of the openings (14). A light bulb (2) is mounted on the holder, with two electrical wires thereof passing through the openings (14) and outwardly bent to cling to two sides of the lower portion of the connection column (11). Next, the subassembly is inserted into a socket shell. With such a conventional structure, when the light bulb is assembled with the holder, two electrical wires (21) are seated inside the grooves (12). The operators have to use fingers to pick up wires and bend them outwardly. Thus the operation is not easy and it is possible to let fingers injured by lead wires. Besides, the connection column (11) of the holder (1) has sharp side edges (13) along the grooves (12). Such sharp edges give the structure poor closeness and can not efficiently prevent moisture from penetration into the interior of the holder. This leads to a possibility of electrical leakage and short-circuit.

In view of the above problems, the primary object of the invention is to provide an improved light bulb holder and socket shell structure in which the shortcomings of the conventional structure have been overcome. Now the features and advantages of the invention will be detailed with reference to the accompanying drawings.

BRIEF DESCRIPTION OF THE ACCOMPANYING DRAWINGS

FIG. 1 shows a conventional miniature light bulb holder.

FIG. 2 indicates an embodiment of the light bulb holder according to the invention.

DETAILED DESCRIPTION OF PREFERRED EMBODIMENTS

Figure 2:
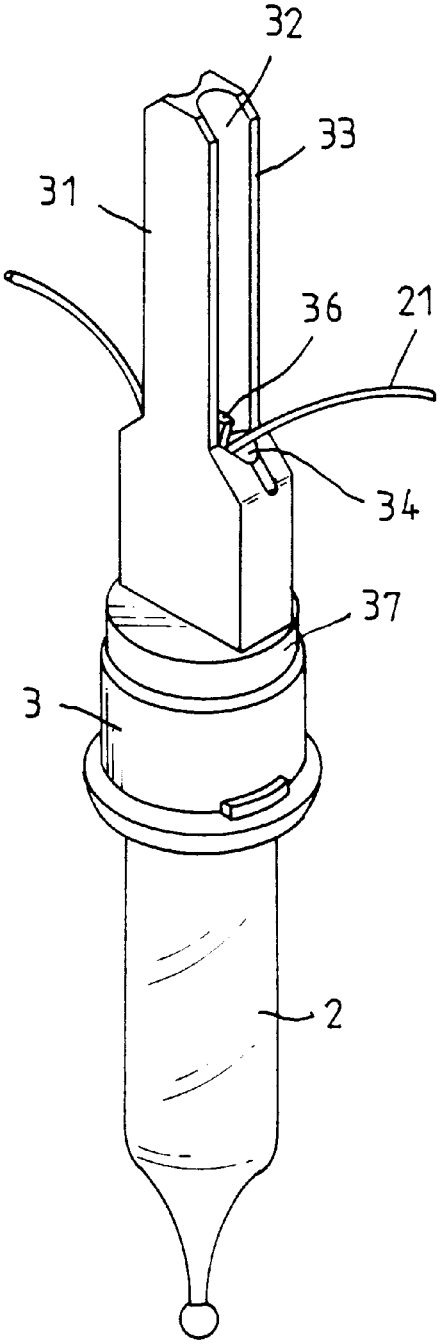
Figure 1:
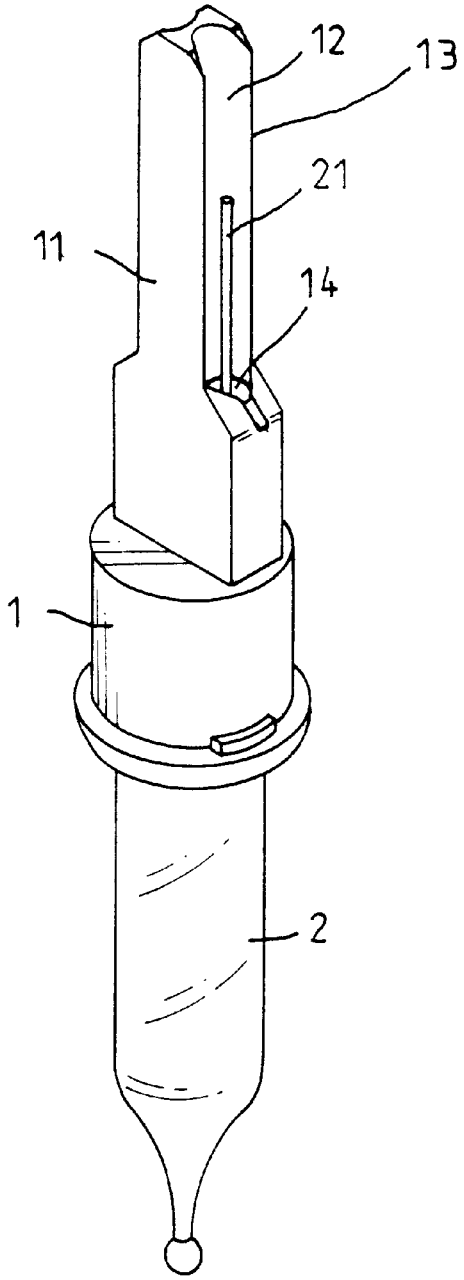
FIG. 1 (prior art)
Figure 3:
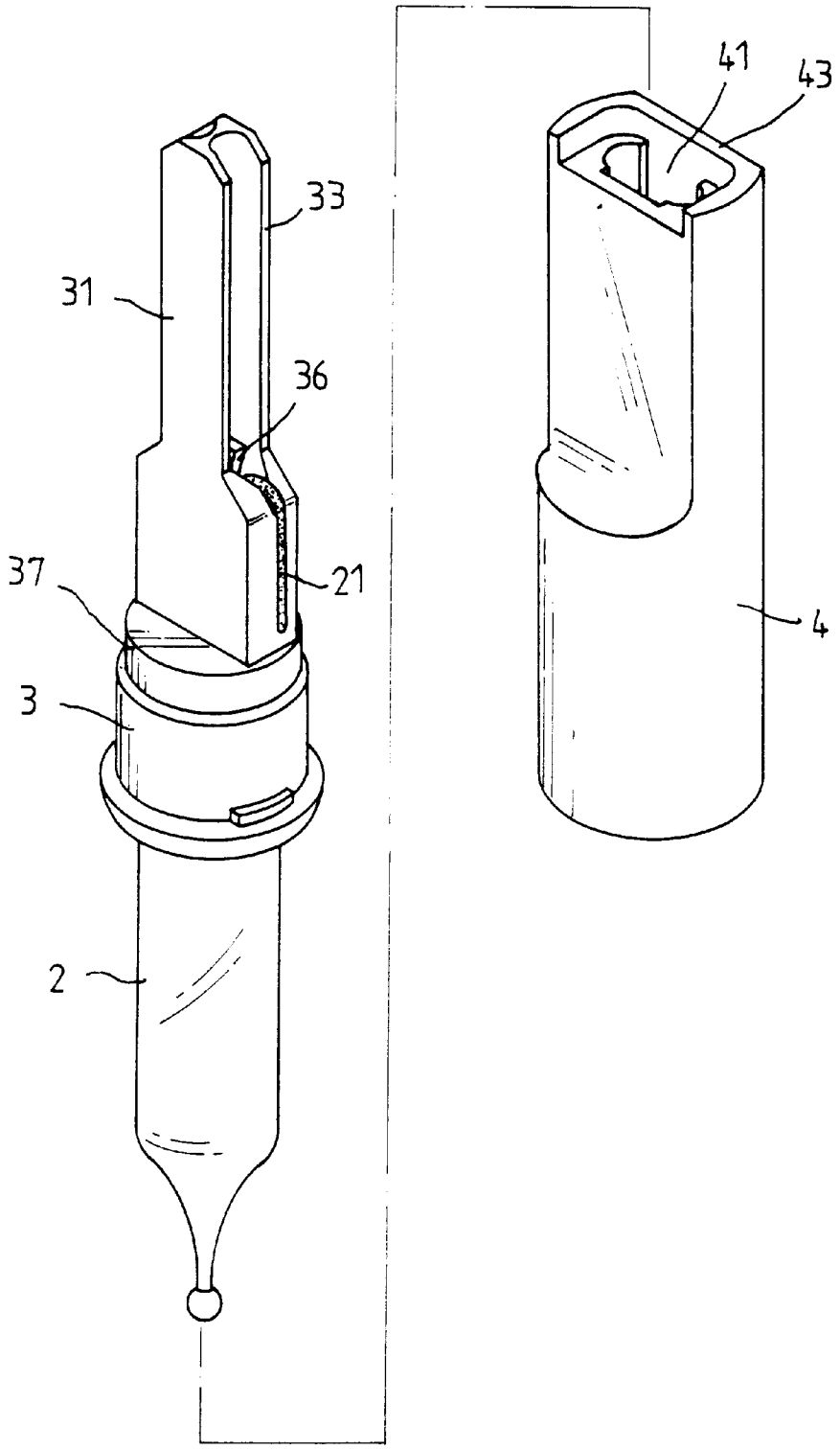
FIG. 3 is an exploded view illustrating an assembly of the light bulb holder and the socket shell according to the invention.
Figure 4:
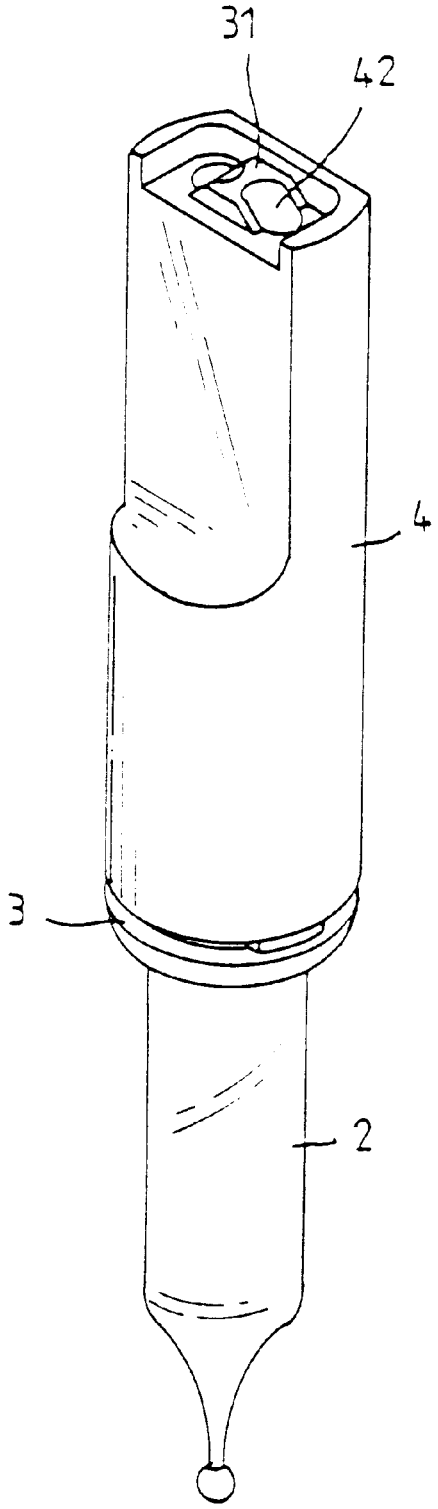
FIG. 4 is a perspective view illustrating an assembly of the light bulb holder and the socket shell of FIG. 3.
Figure 5:
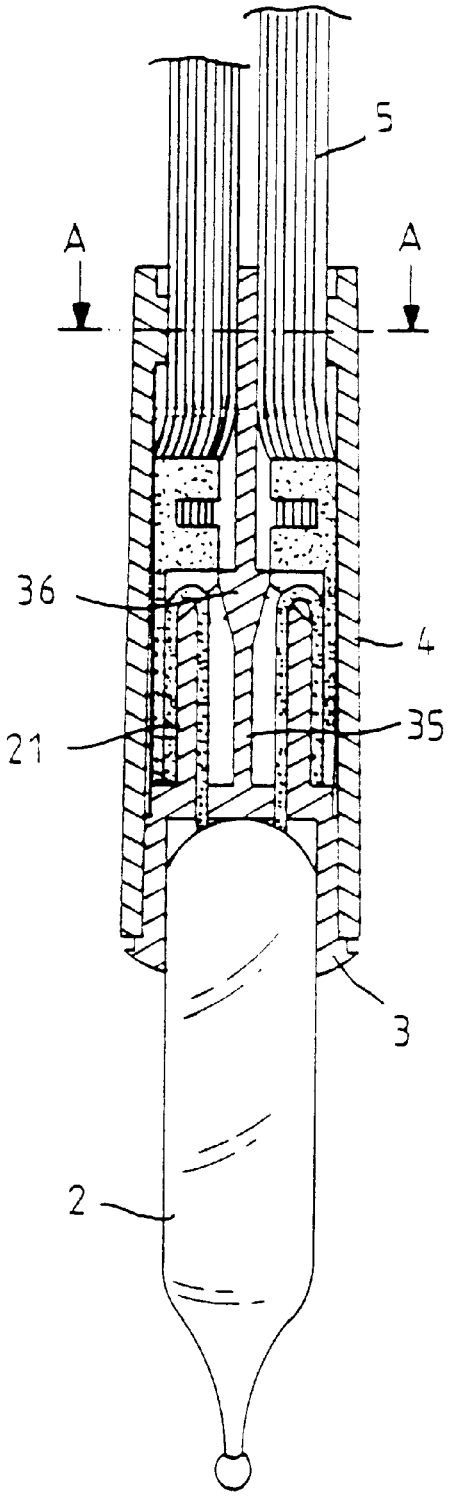
FIG. 5 is a cross-sectional view of the assembly shown in FIG. 4.

The invention can be best understood by referring to FIGS. 2 through 5 that show the improved light bulb holder (3) and socket shell (4). The light bulb holder (3) is provided at one end with a connection column (31). The connection column (31) is further provided on two sides with a groove (32) having a round bottom and recessed groove walls. Formed at the end of the groove (32) is an opening (34) that allows an electrical wire's passing through. A slant guide portion (36) shown in FIG. 5 extends outwardly from the central partition wall (35) of the connection column (31) to the openings (34). Hence, when the electrical wires (21) of a light bulb (2) penetrate the openings, they will be directed sideways to the outside due to the slant guide portion (36) as can be best seen from FIG. 5. In a prior art structure the electrical wires extend from the interior of a holder will stay in the grooves (32) due to a lack of the guidance of slant guide portions. Thus the invention can provide convenience in the operation of bending the electrical wires (21) downward to make them stick to the outer side surfaces of the lower portion of the connection column (31). Besides, the main body of the light bulb holder (3) is provided with a connection portion (37) with a smaller diameter to form a stepped outer surface, which can provide a better fit with the socket shell (4)

The socket shell (4) according to the invention has an opening (41) that has the same contour as the connection column (31). After assembled with the light bulb holder (3), the socket shell (4), in conjunction with the holder, defines the passageway (42) of electrical wires (5) by the grooves (32). The top of the shell (4) is configured to have a recessed portion that is at a different level from the peripheral flange (43). Such a design can prolong the service life of the electrical wires (5) because that the electrical wires (5) receive bending forces at different points when they are bent toward two sides.

Figure 6:
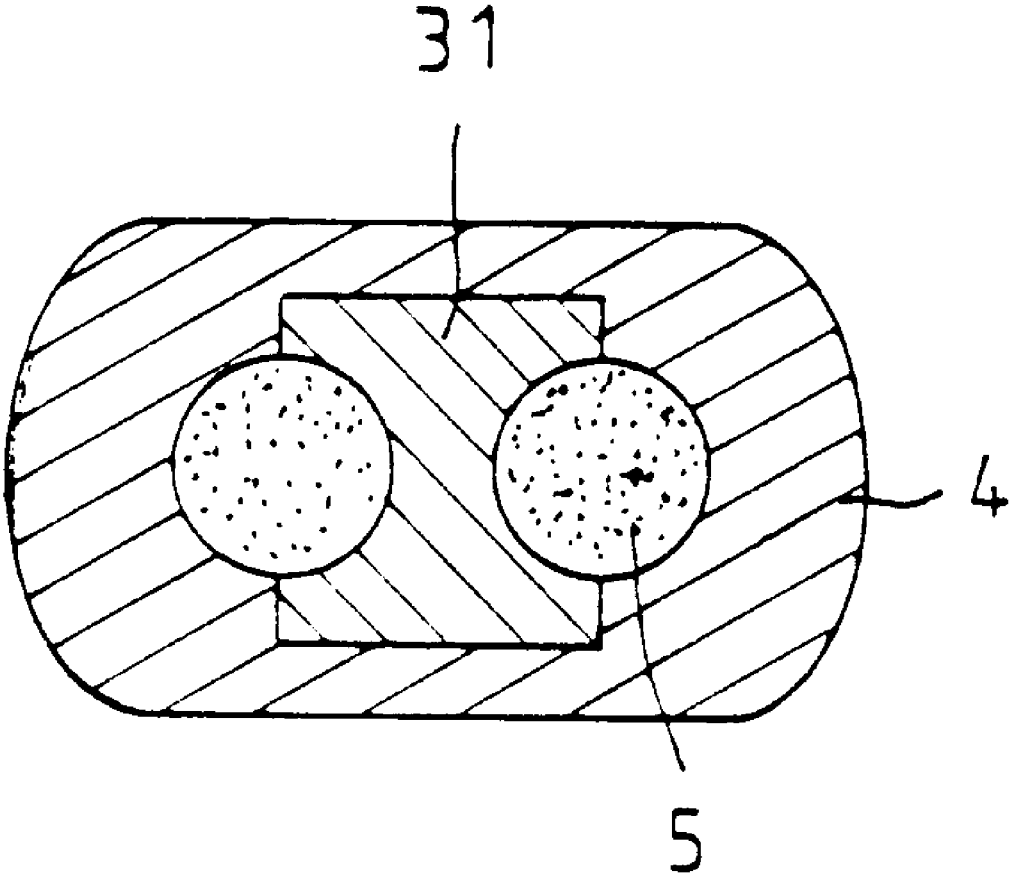
FIG. 6 is a cross-sectional view taken along the line A—A of FIG. 5.

As can be seen from FIG. 6, the round grooves (32) have recessed straight side walls (33), which give a better sealing effect when the holder (3) associated with a socket shell (4) to receive electrical wires. The arrangement can more effectively clamp electrical wires (5) and prevent moisture from penetration into the interior. Evidently the invention has the practical value in the industry and meets the essence of a patent. Thus we hereby file an application for a grant of a patent.

What is claimed is:

1. An improved light bulb holder and socket shell structure comprising a decorative light bulb with two lead wires passing through the openings formed on a light bulb holder, a light bulb holder that has a connection column equipped with a round groove disposed on two sides thereof, and a socket shell receiving said light bulb holder and said light bulb therein; and characterized in that a slant guide portion outwardly extends from the central partition wall of the connection column to said openings so that when the electrical wires of said light bulb penetrate the openings, they will be directed sideways to the outside due to the slant guide portion, which make it easier to bend the electrical wires.

2. The improved light bulb holder and socket shell as claimed in claim 1, in which the round grooves of the connection column have recessed straight side walls and one end of the socket shell is configured to have the same contour as the connection column, and characterized in that after the connection column is inserted into the socket shell the round grooves provide the passageway for electrical wires and the recessed straight side walls closely match with the socket shell to prevent moisture from penetration into the interior of the assembly.

3. The improved light bulb holder and socket shell as claimed in claim 1, in which the main body of the light bulb holder is provided with a connection portion with a smaller outer diameter and with such a stepped outer surface the light bulb holder can provide a better sealing effect when it is put together with the socket shell.

* * * * *